US006055703A

United States Patent [19]

Redding et al.

[11] Patent Number: 6,055,703

[45] Date of Patent: May 2, 2000

[54] UPRIGHT VACUUM CLEANER HAVING IMPROVED STEERING APPARATUS WITH A LOCK OUT FEATURE

[75] Inventors: Glenn K. Redding, Tucson, Ariz.; Kevin Nason, Mountain View, Calif.

[73] Assignee: Oreck Holdings LLC, Cheyenne, Wyo.

[21] Appl. No.: 08/949,411

[22] Filed: Oct. 14, 1997

[51] Int. Cl.[7] ..... A47L 9/00

[52] U.S. Cl. ..... 15/411; 15/351

[58] Field of Search ..... 15/350, 351, 352, 15/339, 411

[56] References Cited

U.S. PATENT DOCUMENTS 1,139,736 5/1915 Stabel ..... 15/411

5,323,510 6/1994 Redding et al. ..... 15/411

5,584,095 12/1996 Redding et al. ..... 15/411

*Primary Examiner*—Elizabeth McKane

*Attorney, Agent, or Firm*—Seed and Berry LLP

[57] ABSTRACT

An upright steerable vacuum cleaner comprised of a handle, body, nozzle base and air duct therein further having a swivel joint at the junction of the nozzle base and body. The swivel joint or steering mechanism comprises a trunnion pivotably connected to the main air duct of the vacuum. The pivotable connection causes the nozzle base of the vacuum to turn right with a clockwise twist of the vacuum handle and turn left with a counter-clockwise twist of the vacuum handle. A locking mechanism is provided for preventing rotation of the trunnion with respect to the air duct.

20 Claims, 7 Drawing Sheets

UPRIGHT VACUUM CLEANER HAVING IMPROVED STEERING APPARATUS WITH A LOCK OUT FEATURE

BACKGROUND OF THE INVENTION

1. Field of the Invention

This invention is directed toward the improved maneuverability of upright model vacuum cleaners.

2. Description of Related Art

A need has been recognized in the vacuum cleaner industry for upright model vacuum cleaners that are easily maneuverable around objects which typically occupy the areas being cleaned. The prior art is replete with upright vacuum cleaners having L-shaped nozzles which assist an operator in cleaning around objects such as chair legs. The prior art does not, however, exemplify upright vacuum cleaners with easy to operate steering mechanisms which facilitate the operator's ability to maneuver the vacuum around any objects.

U.S. patents, U.S. Pat. No. 5,323,510 and U.S. Pat. No. 5,584,095 describe a steerable upright vacuum similar to the present invention. The patents, however, describe a "dirty air" system, i.e. one which includes the vacuum's motor as part of the steering device's swivel mechanism. The present invention, in contrast, is a "clean air" system in which the vacuum's motor is independent of the swivel mechanism and out of the air flow path.

SUMMARY

The present invention provides an upright vacuum cleaner having improved steering features. The essential structure of the vacuum comprises a handle, body, nozzle base and air duct therein. A swivel joint or steering mechanism at the junction of the nozzle base and body comprises a trunnion pivotably connected to the main air duct of the vacuum. The pivotable connection causes the nozzle base of the vacuum to turn right with a clockwise twist of the vacuum handle and turn left with a counter-clockwise twist of the vacuum handle. The main air duct is in air flow communication with a vacuum motor located in the body of the vacuum spaced from a distal end of the air duct with respect to the flow of air.

The vacuum cleaner further comprises a "lock out" feature which permits the operator to selectively engage or disengage the steering feature.

DETAILED DESCRIPTION

In the course of the detailed description the same reference numbers are repeated for the same elements in each of the above described figures.

Figure 1:
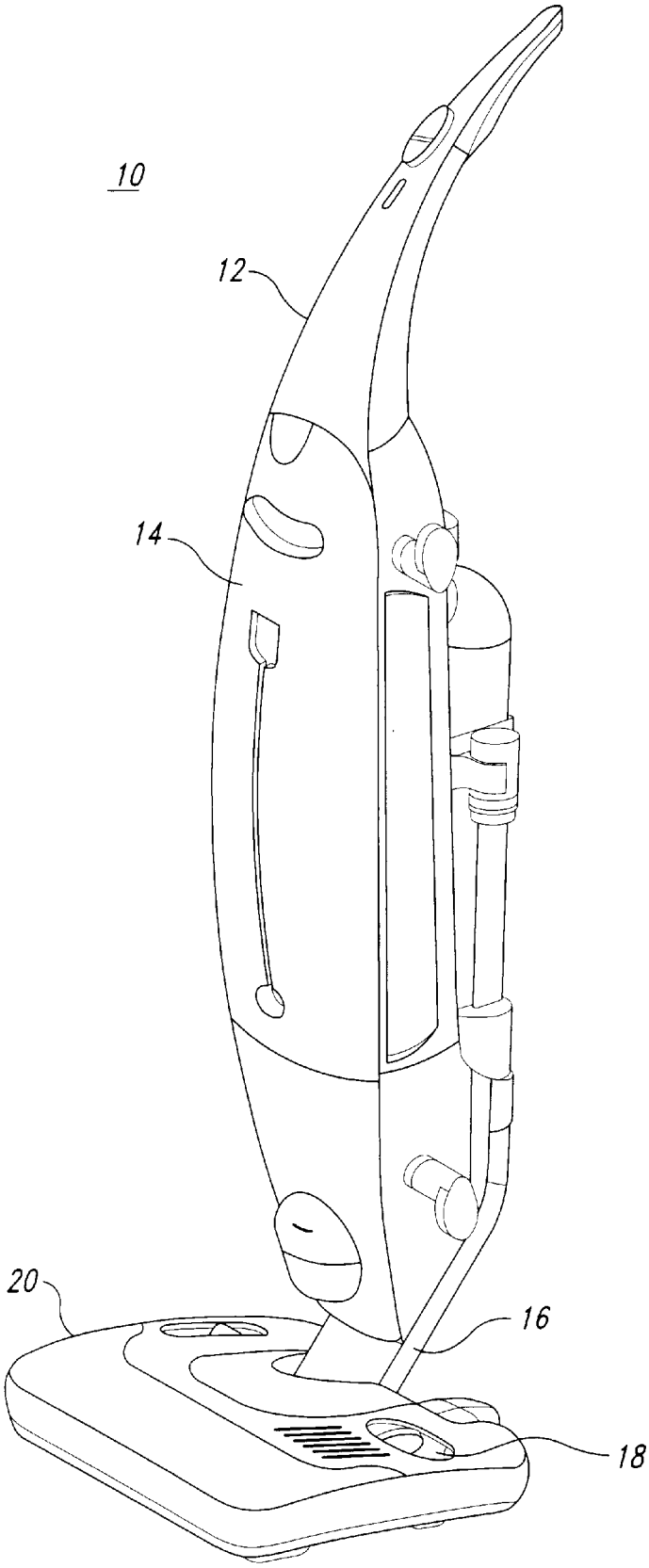
FIG. 1 illustrates a "clean air" model upright vacuum cleaner.

FIG. 1 is a "clean air" model upright vacuum cleaner 10 showing, from the top down, a handle 12 connected to a body 14 connected to a nozzle base 20. Body 14 and nozzle base 20 are joined via swivel joint 16. Also shown on top of nozzle base 20 is a steering lock piece 18 which will be subsequently described in greater detail.

Figure 2:
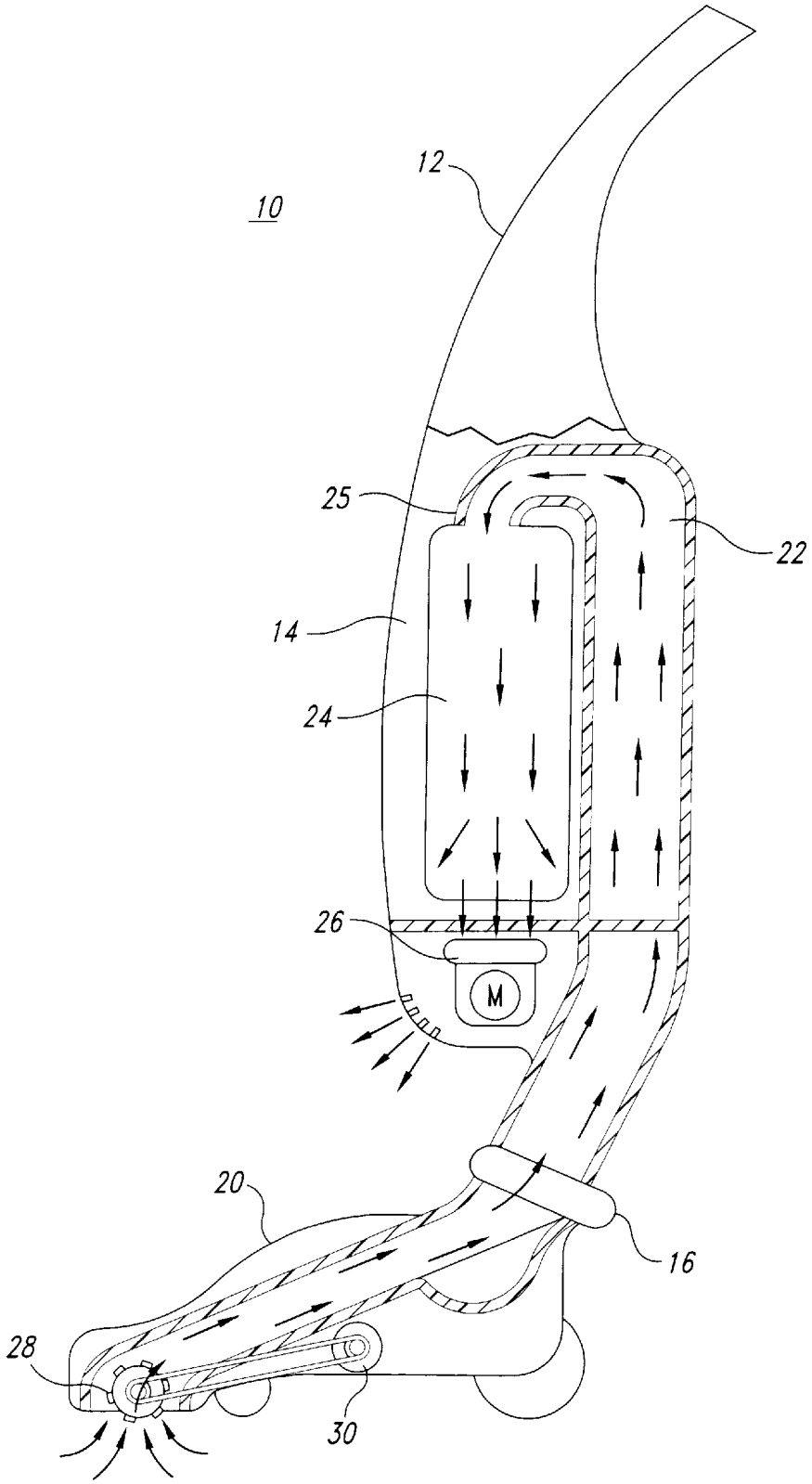
FIG. 2 is a side view of the vacuum cleaner in FIG. 1 showing the internal flow of air throughout the vacuum.

FIG. 2 is a side view of the vacuum cleaner in FIG. 1 showing the internal flow of air throughout the vacuum 10 and some of the internal parts of the vacuum 10. Within nozzle base 20 are shown a brush assembly 28 connected by a belt to a brush drive motor 30. The arrows indicate the path of the air within air duct 22 as it travels through the nozzle base 20 and into body 14. Body 14 houses a bag 24 that receives the waste accumulated during operation of the vacuum 10. The bag is coupled to the air duct 22 at a distal end 25 of the air duct 22 with respect to the flow of air through the vacuum 10. Body 14 also houses motor 26 which provides suction required to create the air flow shown by the arrows. The motor 26 is spaced from the distal end 25 of the air duct with respect to the flow of air through the vacuum 10.

The placement of motor 26 in body 14 below bag 24 is one aspect of the present vacuum which distinguishes it from other upright vacuum models such as that described in U.S. Pat. No. 5,323,510. The '510 patent's motor is housed within the steering mechanism in the path of normal airflow. The prior art steering mechanism is generally located in the area where the body and nozzle base are joined. The present system is termed a "clean air" system because the motor is removed from the normal air path while the vacuum described in U.S. Pat. No. 5,323,510 is termed a "dirty air" system since the motor is in the normal air flow path.

Figure 3:
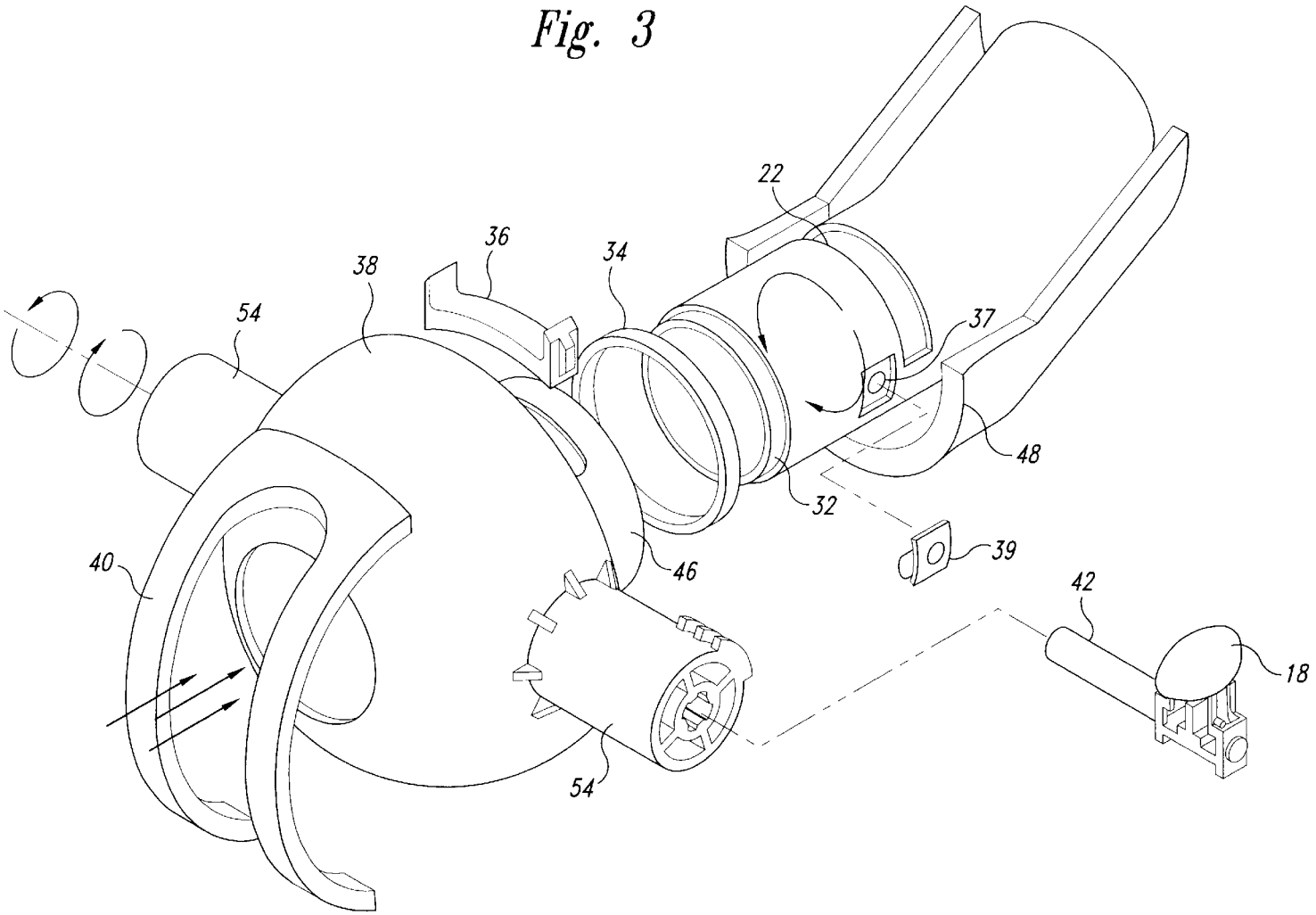
FIG. 3 is an exploded front left perspective view of an exemplary embodiment of the improved steering mechanism.

FIG. 3 is an exploded front left perspective view of the improved steering mechanism. The parts shown fit together to define the swivel joint 16 shown in FIG. 2 as well as the areas immediately before and after said swivel joint 16. Air duct 22 extends down through the length of body 14 ending in an indented male portion 32. The portion of air duct 22 near swivel joint 16 comprises a pair of eccentric substantially cylindrical molded plastic pieces. The inner cylinder is the main air duct 22 while the outer cylinder 48 is molded to the main air duct 22 but is somewhat larger. A single unit trunnion 38 is designed to receive air duct 22. Joint key 36 is inserted through a cut out portion 46 of trunnion 38 into a recess 44 in air duct 22 shaped to receive the lower end of joint key. The joint key 36, the cut out portion 46 of the trunnion 38 and the recess 44 in the air duct 22, thus forming a link assembly. Thus, joint key 36 maintains trunnion 38 and air duct 22 in a fixed relationship with respect to translation, while permitting rotation therebetween. In the exemplary embodiment shown in FIG. 3, a lock pin hole 37 is defined in the air duct 22. The lock pin hole 37 is dimensioned to receive the steering lock pin 42 therein. A reinforcement structure 39 may be provided for reinforcing the lock pin hole 37. The reinforcement structure 39 is shown as a stamped piece of metal having a pocket formed therein, the pocket being dimensioned to receive an end of the steering lock pin 42 therein. The reinforcement structure 39 may be received in a pocket formed on the air duct 22. The link assembly may also include a joint seal 34 which ensures that the connection between air duct 22 and trunnion 38 is air-tight and typically comprises a felt gasket or the like. The felt gasket joint seal 34 fits snugly around indented male portion 32 of air duct 22.

Figure 4:
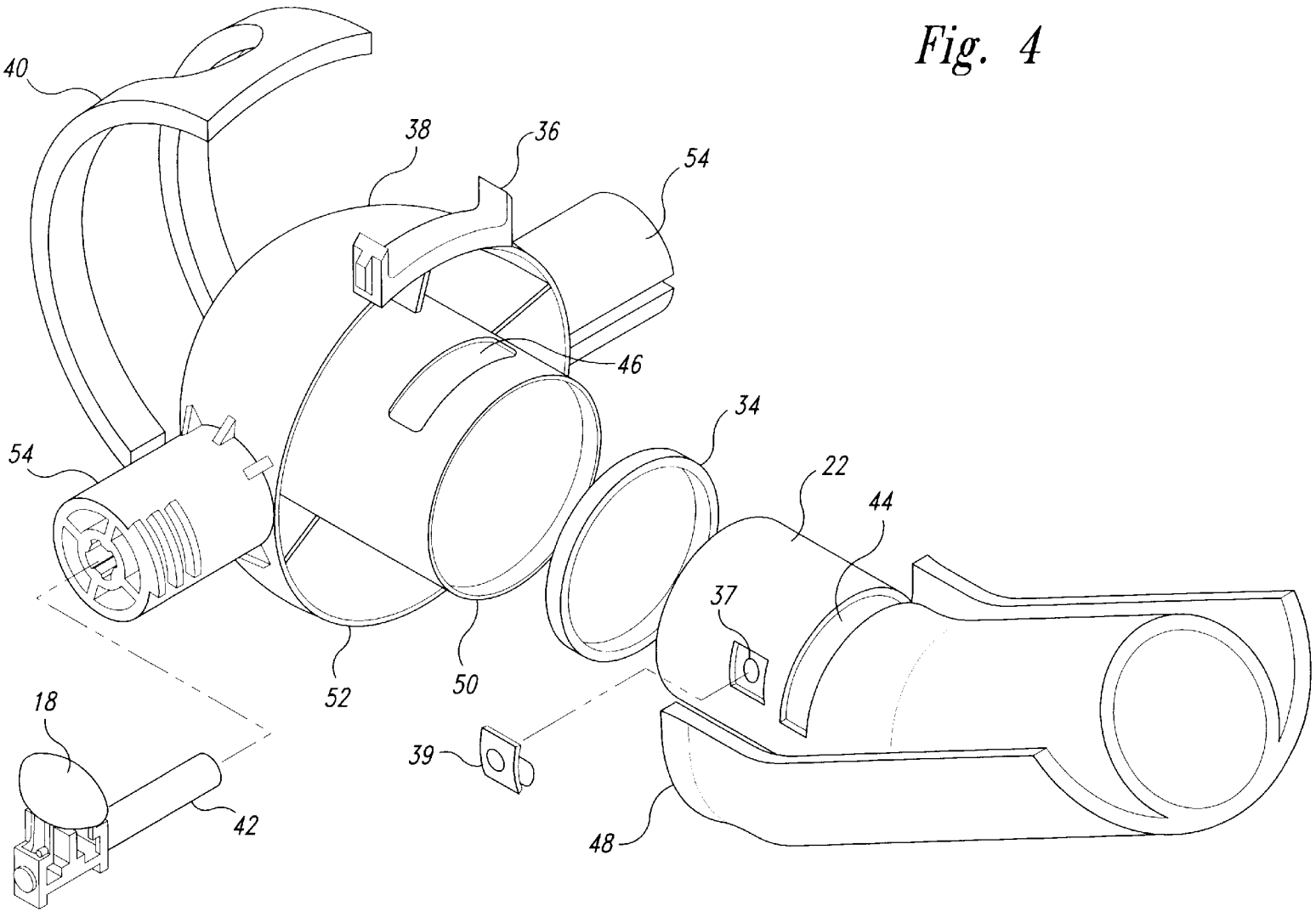
FIG. 4 is an exploded back left perspective view of the exemplary embodiment of the improved steering mechanism of FIG. 3.

FIG. 4 is an exploded back left perspective view of the improved steering mechanism better illustrating how the trunnion 38 accepts air duct 22. In this figure, the trunnion is shown to have concentric inner 50 and outer 52 shells. Inner shell 50 defines the continuation of the air path from body 14 to base nozzle 20. Outer shell 52 provides a surface to which trunnion arms 54 are molded and is sized to match the outer cylinder 48 of air duct 22. Air duct 22 shows recess 44 in which joint key 36 fits. From this angle the indented male portion 32 is not readily visible but joint seal 34 is present and snugly fits over said indented male portion 32 forming a uniform diameter for the air duct 22. The diameter of trunnion 38 is slightly larger than the diameter of air duct 22 and receives same. Air duct 22 is inserted into trunnion 38 until the cut out portion 46 of trunnion 38 is aligned with the recess 44 of air duct 22. Joint key 36 is then inserted through cut out portion 46 into recess 44 and remains in place via a snap-fit type connection.

Figure 5:
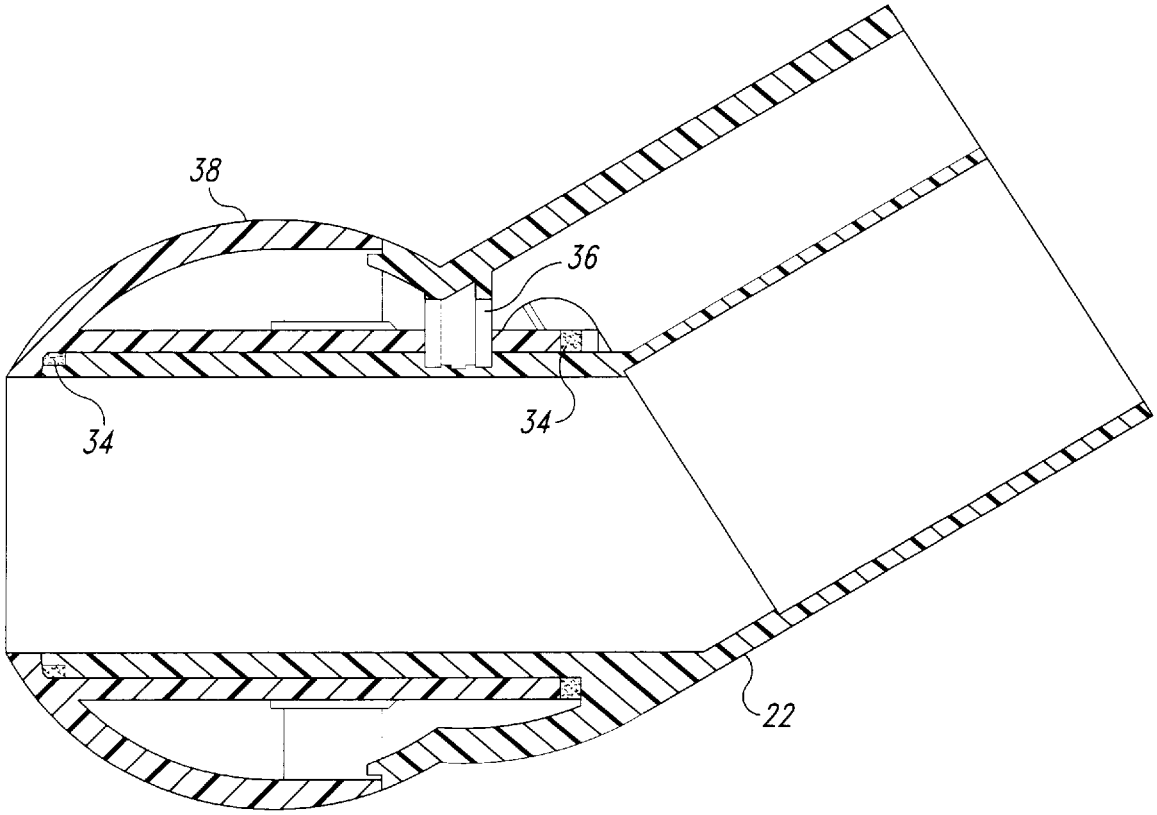
FIG. 5 is a side view of the swivel joint.

FIG. 5 is a side view of the swivel joint area 16 showing trunnion 38 and air duct 22 engaged. For easier reference, trunnion 38 is shown cross hatched from lower left to upper right while air duct 22 is cross hatched from upper left to lower right. Air duct 22 has been inserted into trunnion 38 until cut out portion 46 and recess 44 have been aligned. The felt gasket joint seals 34 seal the joints where trunnion 38 and air duct 22 abut one another. Joint key 36 is shown fully inserted through cut out portion 46 into recess 44. The semi-circular piece 48 of air duct 22 is sized in diameter to match the diameter of the outer trunnion shell 52. When air duct 22 and trunnion 38 are connected inner shell 50 of trunnion 38 abuts via joint seal 34 air duct 22. Likewise, outer shell 52 of trunnion 38 abuts outer cylinder 48 of air duct 22. All of the pieces are then held connected by insertion of joint key 36 as described above.

Figure 6:
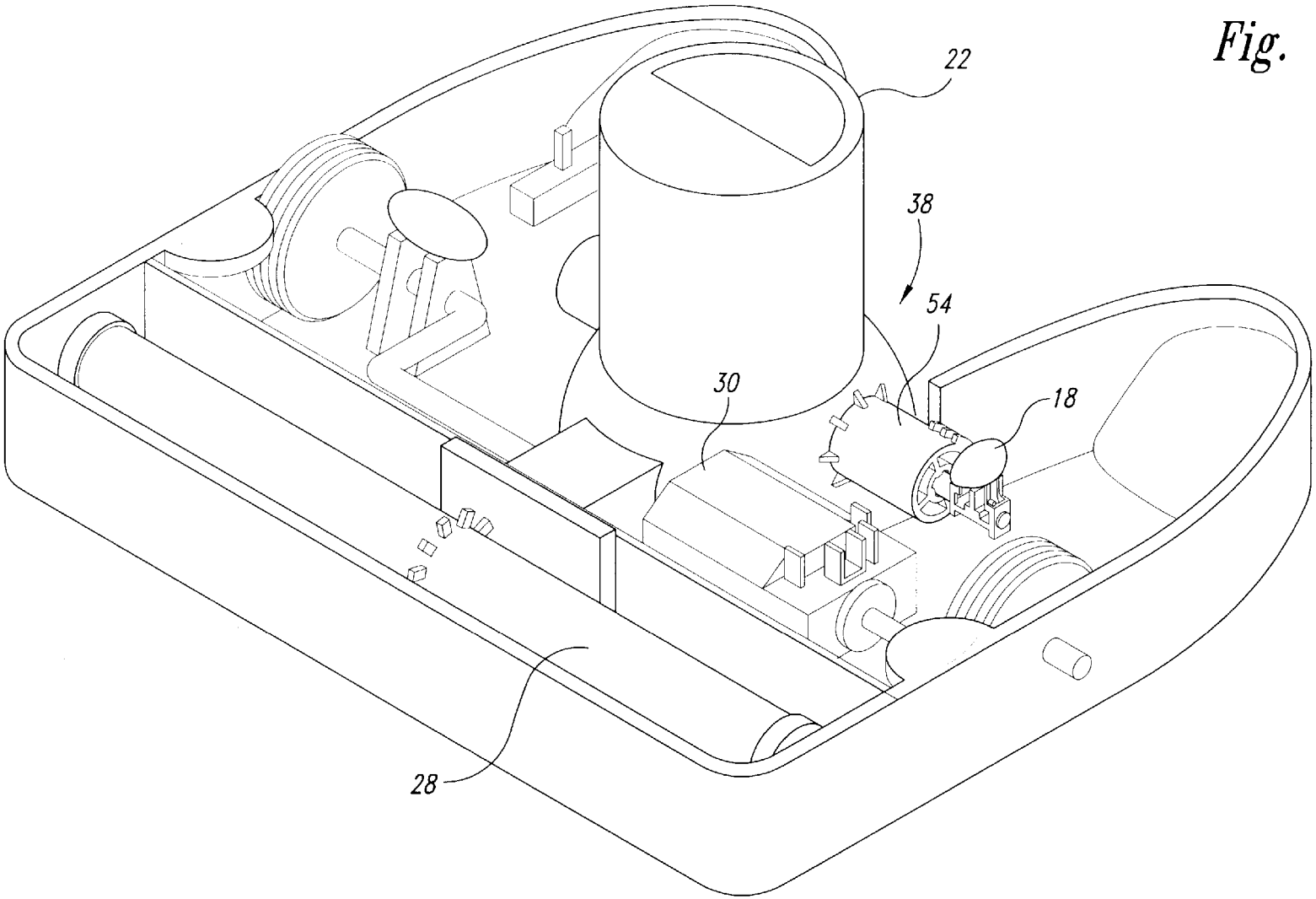
FIG. 6 illustrates a cut away view of the nozzle base of the vacuum.

FIG. 6 illustrates a cut away view of nozzle base 20 showing some of the internal elements contained therein. Air duct 22 is shown extending upward and away from nozzle base 20. Trunnion 38 and trunnion arms 54 are also visible and shown connected to air duct 22. Other elements of the nozzle base such as brush assembly 28 and brush motor 30 are also illustrated.

The elements and connections have been described above. We now describe the operation and working cooperation of those elements that create a vacuum with improved steerability.

The operator first pivots the vacuum cleaner so that body 14 is declined away from its upright position shown in FIG. 1. The vacuum cleaner is pushed forward during operation over the surface to be cleaned. To maneuver the vacuum to the right the operator need only "twist" handle 12 to the right. This action causes handle 12 and body 14 to rotate in a clockwise direction substantially along their shared longitudinal axis. The clockwise rotation force exerted along the handle 12 and body 14 axis is translated down to trunnion 38 and applied to trunnion arms 54. Trunnion arms 54 possess a shared longitudinal axis which is orthogonal to the shared longitudinal axis of the handle and body. The two axes intersect in the center of trunnion 38. The clockwise force along the handle and body axis is translated into a "pitch up" force along the axis of trunnion arms 54. (See, FIG. 3) Since trunnion arms 54 are housed within nozzle base 20, the "pitch up" force causes nozzle base 20 to veer to the right. Similarly, a counter-clockwise "twist" of handle 12 will be translated into a "pitch down" force along trunnion arms 54 causing nozzle base 20 to veer left. The combination of continued forward pushing of the vacuum while twisting the handle results in nozzle base 20 turning left or right depending on the direction of the handle twist. The effect is an upright style vacuum cleaner with significantly improved maneuverability.

The air flow throughout the unit is illustrated in FIG. 2. Motor 26 is housed within body 14 beneath bag 24. When energized, motor 26 causes air to drawn from beneath nozzle base 20 into air duct 22. Air duct 22 passes through trunnion 38 into body 14 ending in bag 24.

It may be understood that the operator of the vacuum 10 may wish to "lock out" the swivel mechanism in order to operate the vacuum much the same as prior art devices. Such a "lock out" feature is provided by the use of a steering lock 18 as shown in FIGS. 1, 3, 4, and 6.

Steering lock 18 is a hand actuated L-shaped device comprised of a slider and a pin. Referring to FIG. 1., the slider portion is visible on top of nozzle base 20. Steering lock pin 42 is fixed to the knob like slider portion and resides within nozzle base 20. The slider portion sits atop nozzle base 20 in a recessed slotted portion of said nozzle base such that slider lock pin 42 is colinear with the axis of trunnion arm 54. The slot runs parallel to but above steering lock pin 42 and allows for hand actuation or sliding of the steering lock along the length of the slot.

Trunnion arm 54 is a cylindrical tube-like protrusion stemming from trunnion 38. The end of trunnion arm 54 is open and has a smaller concentric inner tube supported therein. This inner tube is sized in diameter to receive steering lock pin 42. To lock out the steering mechanism the operator moves the slider portion of steering lock 18 toward the center of nozzle base 20. Slider lock pin 42 is received by trunnion arm 54 and extends through the inner tube and into the lock pin hole 37 thereby locking out the steering mechanism with respect to rotation. FIG. 6. shows steering lock 18 from above as if nozzle base 20 were not there.

Figure 7:
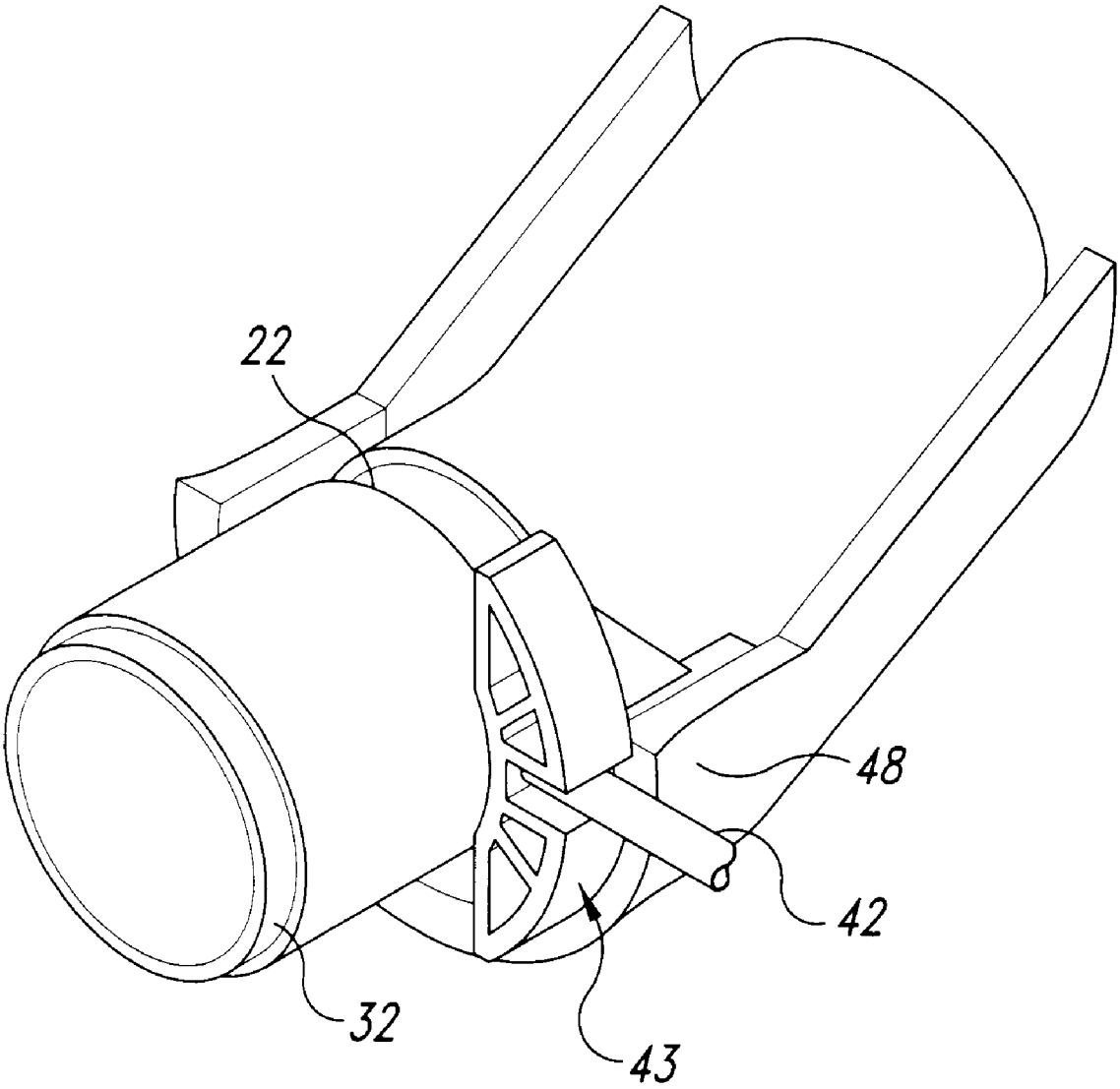
FIG. 7 is a front left perspective view of an exemplary embodiment of the improved steering mechanism having an alternative locking mechanism.

With reference to FIG. 7, a steering lock structure 43 is shown formed on the air duct 22. The steering lock structure 43 lockingly engages the steering lock pin 42 when the steering lock pin 42 is moved into the locked position, thereby preventing rotation between the air duct 22 and the trunnion 38.

As discussed previously, the present invention is part of a "clean air" upright vacuum cleaner. This means that the vacuum motor is located outside of the normal air path. In this case it has been removed from the nozzle base area to the body area. As a result, the vacuum has a much lower nozzle base profile. The mass of the nozzle base is significantly reduced due also to the relocation of the motor. The result is an upright vacuum with significantly greater maneuverability. With the weight re-distributed away from the base and more toward the handle, an operator need not work as hard to effect the steering features. The nozzle base is much more responsive to the operator and achieves more of a turning effect and less of a sliding effect during use. The lower profile has obvious advantages as well. The vacuum can now fit under low to the ground objects, i.e. sofas, ottomans, certain tables, etc. . . . , that it could not have before.

While the invention has been described with respect to the description above, it will be noted that variations and modifications may be effected without departing from the spirit and scope of the invention as a whole.

What is claimed is:

1. A vacuum cleaner comprising:

a base;

a substantially upright elongate body portion having a longitudinal axis and including a handle portion and an air duct;

a substantially spherically shaped trunnion pivotally attached to said base about a substantially horizontal pitch axis, said trunnion defining an air channel capable of facilitating the flow of air from said base to said air duct within said body portion;

a link assembly for linking said trunnion to said air duct such that said body may be rotated about said longitudinal axis while pushing said vacuum by twisting said handle in a clockwise or counter-clockwise direction causing said base to veer right or left depending on the direction in which said handle is twisted; and a steering lock slidingly mounted in the base such the steering lock selectively engages the trunnion and the air duct, barring the handle twisting motion from turning said base.

2. The vacuum of claim 1 wherein said longitudinal axis and said horizontal pitch axis are substantially orthogonal.

3. The vacuum of claim 2 wherein said trunnion further comprises:

a pair of opposed co-linear cylindrical arms extending outward from the trunnion surface along said substantially horizontal pitch axis; and a tube member within said trunnion sphere for receiving a portion of said air duct; and a cut out area on said tube member for receiving said link assembly.

4. The vacuum of claim 3 wherein said air duct further comprises:

a uniform indention about the terminal rim of said air duct; and a slightly recessed portion on the outside surface of said air duct shaped to match said cut out area such that when said air duct is received by said trunnion tube member at the proper length said link assembly is inserted through said cut out area into said recessed portion of said air duct fixably linking said trunnion with said air duct with respect to translation while permitting rotation therebetween.

5. The vacuum of claim 4 further comprising:

a gasket fitted about said uniform indention about the terminal rim of said air duct for ensuring an air-tight link between said trunnion and said air duct.

6. The vacuum of claim 5 wherein said gasket is comprised of felt.

7. The vacuum of claim 6 wherein said link assembly is a substantially rectangular molded plastic joint key.

8. The vacuum of claim 7 wherein said steering lock is L-shaped comprising a slider attached to a steering lock pin wherein said slider sits atop said base while said pin is housed within said base co-linear with said horizontal pitch axis.

9. The vacuum of claim 8 wherein one of said trunnion arms is adapted to receive said steering lock pin such that when said slider is moved toward the center of said base said pin is received through an inner tube of said trunnion arm and lockingly engages the air duct thereby preventing any handle twisting motion from causing said base to turn.

10. A vacuum cleaner comprising:

a base;

a substantially upright elongated body portion having a longitudinal axis and an air duct; and a substantially spherically shaped trunnion having an inner shell, the inner shell defining an air path through the trunnion, the trunnion pivotally attached to the base about a substantially horizontal pitch axis and the inner shell of the trunnion rotatably mounted to the air duct of the body for movement about the longitudinal axis independently of movement about the longitudinal pitch axis.

11. The vacuum of claim 10 wherein the longitudinal axis and the horizontal pitch axis are substantially orthogonal.

12. The vacuum of claim 10 wherein said trunnion further comprises:

an outer shell surrounding at least a portion of the inner shell.

13. The vacuum of claim 10 further comprising:

a motor, the motor mounted in the body of the vacuum and spaced from a distal end of the air duct with respect to a flow of air through the vacuum.

14. A vacuum cleaner comprising:

a base;

a substantially upright elongated body portion having a longitudinal axis and an air duct;

a substantially spherically shaped trunnion having an inner shell, the inner shell defining an air path through the trunnion the trunnion pivotally attached to the base about a substantially horizontal pitch axis and the inner shell of the trunnion rotatably mounted to the air duct of the body for movement about the longitudinal axis; and a joint key, the joint key received through a cut out area defined through the inner duct of the trunnion and into a recessed portion defined in an outside surface of the air duct.

15. A vacuum cleaner comprising:

a base;

a substantially upright elongated body portion having a longitudinal axis and an air duct; and a substantially spherically shaped trunnion having an inner shell, the inner shell defining an air path through the trunnion, the trunnion pivotally attached to the base about a substantially horizontal pitch axis and the inner shell of the trunnion rotatably mounted to the air duct of the body for movement about the longitudinal axis;

an arm extending outward from the trunnion surface; and a steering lock pin, the steering lock pin slidingly mounted in the base for movement between a steering locked position in which the steering lock pin lockingly engages the arm and the air duct and a steering unlocked position in which the steering lock pin disengages from the air duct.

16. A vacuum cleaner comprising a base;

a substantially upright elongated body portion having a longitudinal axis and an air duct;

a substantially spherically shaped trunnion having an inner shell, the inner shell defining an air path through the trunnion, the trunnion pivotally attached to the base about a substantially horizontal pitch axis and the inner shell of the trunnion rotatably mounted to the air duct of the body for movement about the longitudinal axis;

a pair of opposed co-linear cylindrical arms extending outward from the trunnion surface along said substantially horizontal pitch axis, the cylindrical arms having a concentric inner tube therein; and a steering lock pin received in the base and collinear with the horizontal pitch axis, the steering lock pin slidable between a steering locked position in which the steering lock pin is lockingly received in a one of the inner tubes and the air duct and a steering unlocked position in which the steering lock pin disengages from the air duct.

17. The vacuum of claim 16 wherein the steering lock pin has a slider, the slider extending out of the base.

18. The vacuum of claim 16 wherein a locking pin hole is defined in the air duct for selectively lockingly receiving the steering lock pin.

19. The vacuum of claim 18, further comprising a reinforcement structure received in the locking pin hole.

20. The vacuum of claim 16 wherein a locking pin structure is formed on the air duct for selectively lockingly receiving the steering lock pin.

* * * * *